United States Patent [19]

Yautz, Jr. et al.

[11] 4,211,320

[45] Jul. 8, 1980

[54] APPARATUS FOR COMBINING SHEET MATERIAL ASSEMBLAGES

[75] Inventors: Michael S. Yautz, Jr., Easton; Richard N. Winslow, Media, both of Pa.

[73] Assignee: Harris Corporation, Cleveland, Ohio

[21] Appl. No.: 919,440

[22] Filed: Jun. 26, 1978

[51] Int. Cl.[2] ..... B65G 47/68

[52] U.S. Cl. ..... 198/450; 271/82; 271/187; 271/216

[58] Field of Search ..... 198/450, 479, 480; 271/9, 80, 82, 187, 216, 243, 277, 64, 188, 83; 270/55

[56] References Cited

U.S. PATENT DOCUMENTS

| | | | |
|---|---|---|---|
| 1,325,550 | 12/1919 | Wood | 271/80 |
| 1,843,474 | 2/1932 | Wood | 271/187 |
| 2,031,136 | 2/1936 | Sewick | 271/80 |
| 2,944,813 | 7/1960 | Smith | 271/188 |
| 3,267,821 | 8/1966 | Rowlands | 198/450 |
| 3,476,384 | 11/1969 | Thull et al. | 271/188 |
| 3,487,447 | 12/1969 | Fusco | 271/64 |
| 3,749,398 | 7/1973 | Fujita et al. | 271/188 |
| 3,874,649 | 4/1975 | Bryson et al. | 270/55 |
| 3,968,960 | 7/1976 | Fedor et al. | 271/187 |
| 4,060,231 | 11/1977 | Stobb et al. | 271/80 |
| 4,132,403 | 1/1979 | Weisbach et al. | 271/277 |

*Primary Examiner*—Joseph E. Valenza

[57] ABSTRACT

Apparatus for combining newspapers from a pair of newspaper stuffing assemblies into a single stream of overlapped newspapers. A rotatable tine wheel has on its periphery a number of movable newspaper receiving tines interspersed with a like number of fixed newpaper receiving tines. Newspapers are fed to the fixed tines from a pocket of a newspaper stuffing assembly and to the movable tines from a feed apparatus supplied by a conveyor from a second stuffing assembly. The fixed and movable tines alternately deposit the newspapers upon a single delivery conveyor overlapping a previously deposited newspaper to form a single, lapped stream. The movable tines are movable between a newspaper receiving position and a position out of the newspaper receiving path of an adjacent fixed tine.

7 Claims, 8 Drawing Figures

APPARATUS FOR COMBINING SHEET MATERIAL ASSEMBLAGES

BACKGROUND OF THE INVENTION

This invention relates generally to an apparatus for assembling sheet material and more particularly to an apparatus for combining sheet material assemblages such as newspapers from a plurality of stuffer assemblies for conveying in a single stream to a receiving station.

A known newspaper stuffing mechanism includes a plurality of stuffing assemblies, each of which is adapted to assemble a complete newspaper. The newspapers from the two assemblies may be deposited upon two separate conveyors which transport the newspapers to two different receiving stations or the newspapers may be combined and transported to the same receiving station by a single conveyor. In the latter case, a series of complete newspapers from a first of the stuffer assemblies is deposited on the conveyor in an overlapped or shingled stream. When they reach the delivery station for a second stuffer assembly, the stream is unshingled and newspapers from the second assembly are interspersed between the newspapers from the first assembly. The resulting combined stream of unlapped newspapers from the two stuffer assemblies is then shingled by a shingling mechanism. The single stream of overlapped newspapers is then transported by the conveyor to a receiving station. Such an arrangement is shown in U.S. Pat. No. 3,874,649.

Although the newspaper stuffer mechanism disclosed in that patent is believed to represent a substantial improvement over prior art mechanisms the need for handling the streams with greater speed and efficiency is always present.

SUMMARY OF THE INVENTION

According to the present invention, there is provided apparatus for combining newspapers from the two assemblies which is simpler and allows higher speed operation than combining apparatus previously employed. A rotatable tine-wheel is provided at the delivery station for the second stuffer assembly and receives newspapers from both the second assembly and from a conveyor from the first assembly. The newspapers from both assemblies are deposited by the tine-wheel onto a single delivery conveyor in a shingled stream which is transported by the conveyor to a receiving station.

The tine-wheel includes on its periphery a plurality of fixed newspaper receiving tines and a plurality of movable newspaper receiving tines interspersed between the fixed tines. The fixed tines receive newspapers from the second stuffing assembly and the movable tines receive newspapers from a conveyor from the first stuffing assembly. The movable tines pivot from a newspaper receiving position to a position providing a clear path for a neighboring fixed tine to receive a newspaper. The movable tine is then returned to its newspaper receiving position to receive a newspaper from the conveyor. As the tine-wheel continues to rotate the newspapers from both assemblies are deposited in turn onto a delivery conveyor in an overlapped stream for transporting to a receiving station.

DESCRIPTION OF A PREFERRED EMBODIMENT

Figure 1:
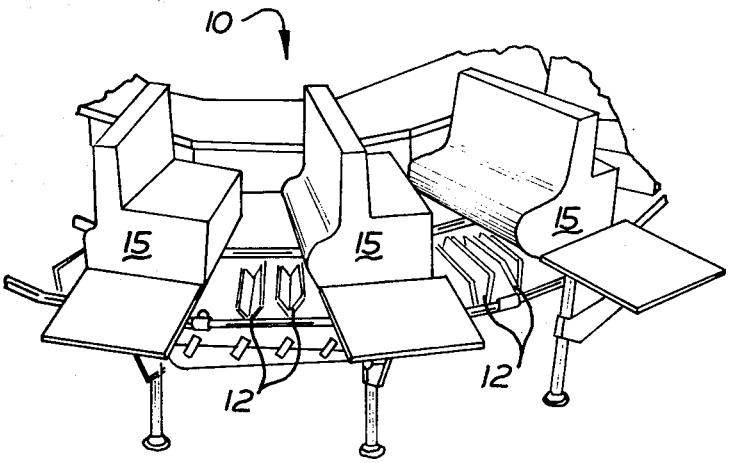
FIG. 1 is a schematic illustration of a portion of a newspaper stuffing mechanism.
Figure 2:
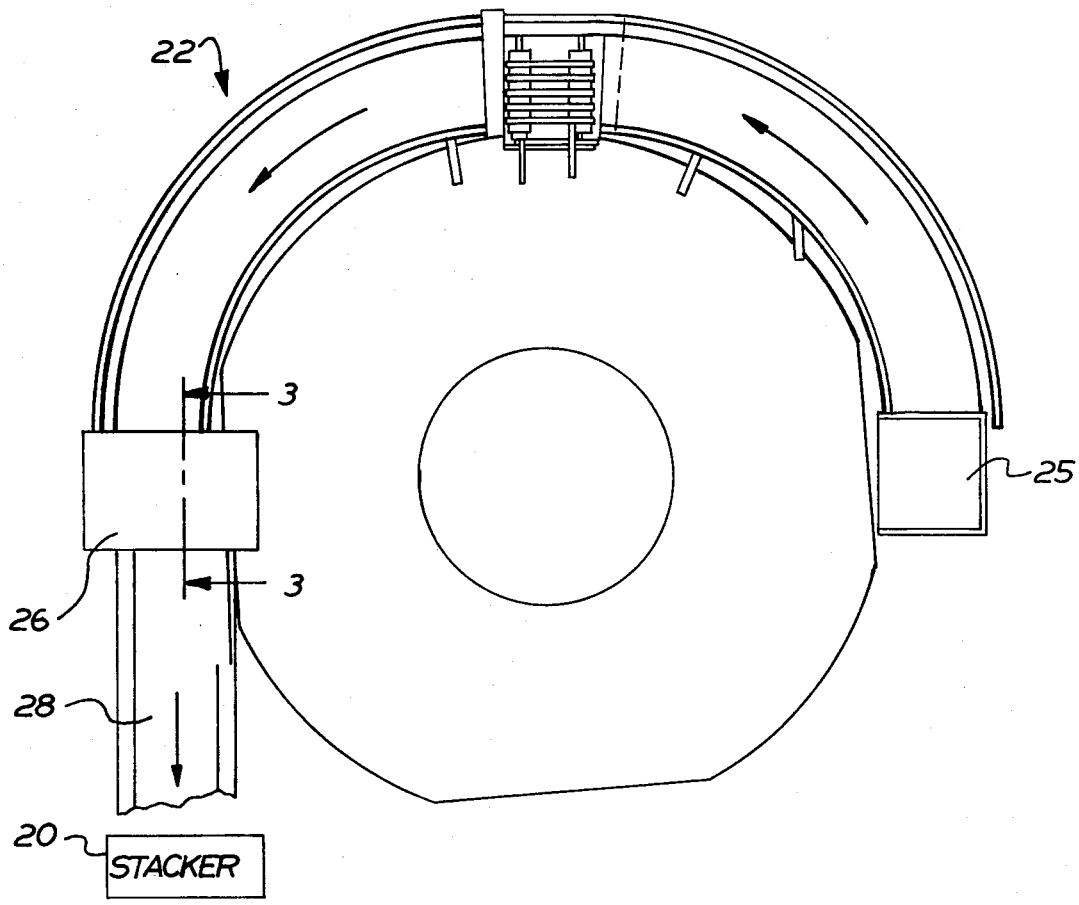
FIG. 2 is a schematic plan view of a conveyor assembly located beneath the stuffing mechanism of FIG. 1 for transporting newspapers to a single receiving station.

There is shown in FIG. 1 a portion of a newspaper stuffing mechanism 10 such as that described in U.S. Pat. No. 3,874,649 which is incorporated herein by reference. The mechanism 10 includes a pair of semicircular stuffer assemblies each of which is adapted to assemble complete newspapers. Each of the stuffer assemblies includes a series of v-shaped receiving pockets 12 arranged in a circular array. An endless stream of such pockets 12 is moved in a circular path beneath a plurality of bottom-feed hoppers 15 in each of the two stuffer assemblies. The pockets 12 are first provided with newspaper jackets and are then fed inner sections of a newspaper in turn as the pockets are moved in sequence past hoppers 15, all of which is known and described in the aforementioned U.S. Pat. No. 3,874,649. The completed newspapers from the two stuffer assemblies are transported to a receiving station, such as a stacker 20 (FIG. 2) by a single conveyor assembly 22 which is located beneath the pockets 12 in FIG. 1.

To accomplish this, the newspapers from one stuffer assembly are deposited on the conveyor 22 in a shingled or overlapped stream at a first delivery station 25. These newspapers are moved by the conveyor to a second delivery station 26 where complete newspapers from the second stuffer assembly are interspersed with those from the first stuffer assembly. A single stream of combined newspapers from the two stuffer assemblies is then transported to stacker 20 by delivery section 28 of conveyor 22.

According to the present invention, the completed newspapers or other sheet material assemblages from the two sources are combined by apparatus which is simpler and more efficient and allows higher speed operation than combining apparatus previously employed.

Figure 3:
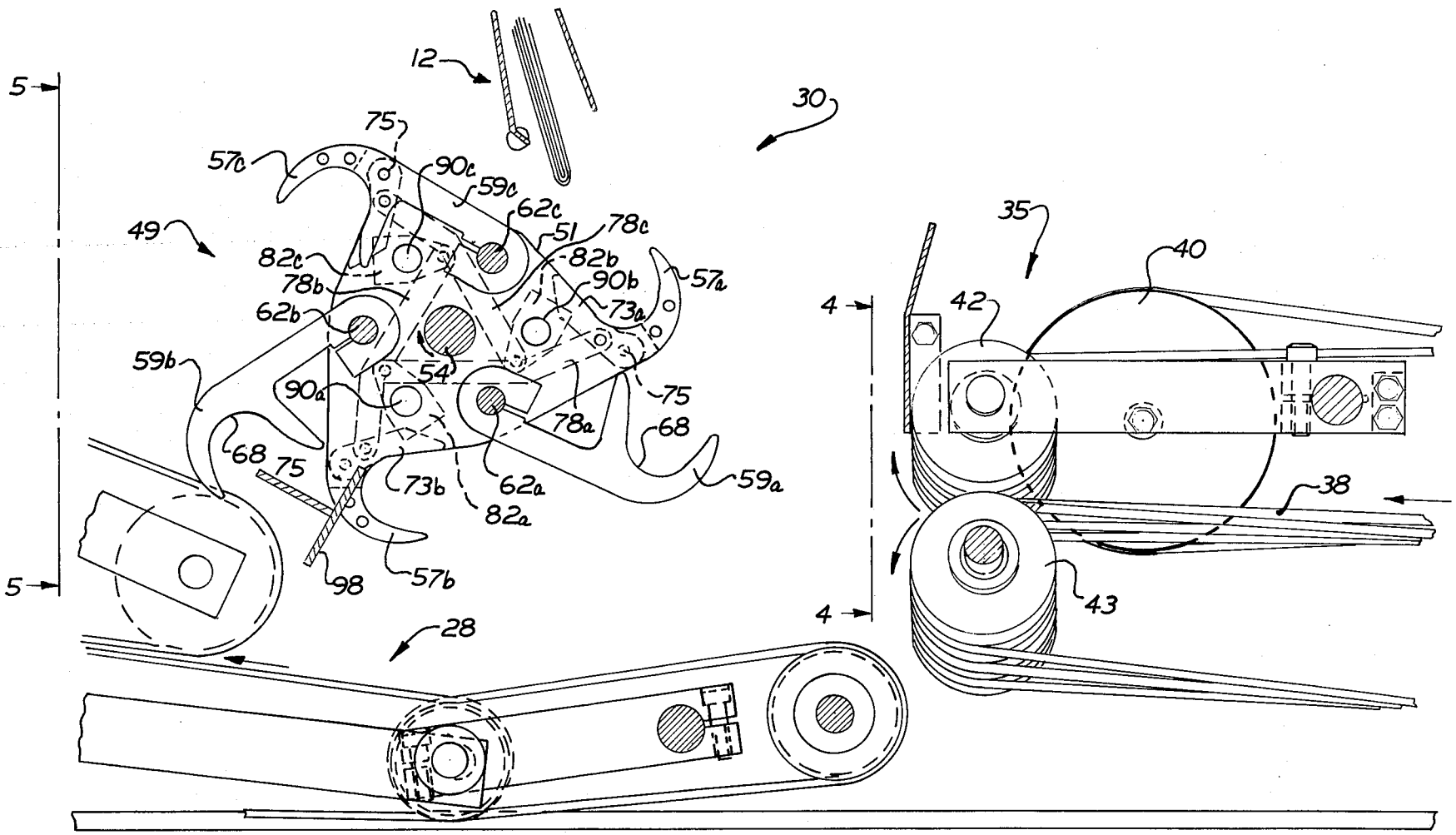
FIG. 3 is a view along the line 3—3 of FIG. 2 of apparatus embodying the present invention for combining newspapers from a plurality of stuffer assemblies for conveying in a single stream to a receiving station.
Figure 4:
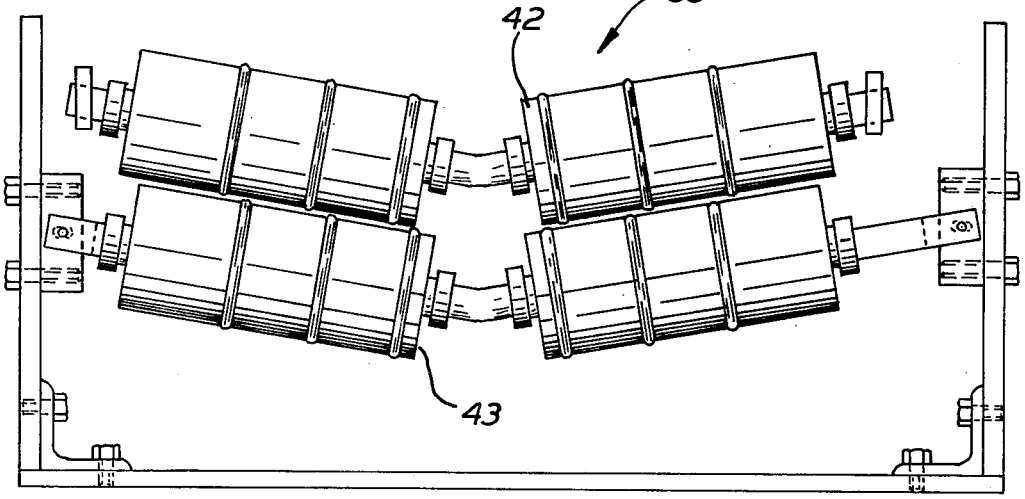
FIG. 4 is a view along the line 4—4 of FIG. 3.

Referring to FIGS. 3 to 8, at delivery station 26 newspapers are provided to combining apparatus 30 from the two stuffer assemblies as indicated in FIG. 3. As each pocket 12 of the second stuffer assembly arrives at delivery station 26 it is opened in a manner disclosed in U.S. Pat. No. 3,874,649 and the completed newspaper therein is fed to combining apparatus 30. At the same time, the completed newspapers on conveyor 22 from the first stuffer assembly are supplied to combining apparatus 30 via feeding apparatus generally designated 35. Prior to reaching feeding apparatus 35, the overlapped newspapers on conveyor 22 are separated into an unlapped stream. This is accomplished as disclosed in U.S. Pat. No. 3,874,649 by accelerating each newspaper to a speed which is more than twice as great as the speed at which the newspapers are transported by conveyor 22. This results in each newspaper being moved out of its lapped relationship with the next succeeding newspaper.

Each newspaper is then fed along belts 38 of feeding apparatus 35 where it is accelerated and passed beneath a disk 40 and between a pair of slanted rollers 42 and 43. Opposite sides of each newspaper are deflected upwardly by slanted rollers 42 and 43 about a central line of curvature established by disk 40. The slanted rollers 42, 43 feed the accelerated newspaper to combining apparatus 30. The curvature and velocity provided to each newspaper stabilizes it in its path to combining apparatus 30. The combining apparatus 30 receives a newspaper from pocket 12 and another from feed apparatus 35 and deposits the two in a shingled or overlapped condition on delivery conveyor 28.

As shown in FIGS. 3 and 5–8 combining apparatus 30 includes a frame 48 which supports a rotatable tine-wheel 49. The tine-wheel includes a pair of tine plates 50 and 51 mounted on a common rotatable shaft 54. Each tine plate 50, 51 includes a number of fixed newspaper receiving tines, three being shown and identified as **56*a*, 56*b*, and 56*c* for plate 50 and 57*a* to 57*c* for plate 51, and a like number of movable newspaper receiving tines 58*a* to 58*c* for plate 50 and 59*a* to 59*c* for plate 51. Each pair of movable tines 58*a* and 59*a*, 58*b* and 59*b*, and 58*c* and 59*c* is mounted on a separate operating shaft 62*a*, 62*b* and 62*c*, respectively, which is supported in tine plates 50 and 51 for rotation with respect thereto. Accordingly, the movable tines 58*a* to 58*c* on plate 50 are pivotable with respect to the corresponding fixed tines 56*a* to 56*c* and the movable tines 59*a* to 59*c* on plate 51 are pivotable with respect to the corresponding fixed tines 57*a* to 57*c*. Each movable tine 58*a* to 59*c* has a curved newspaper receiving portion 68** at its outer end.

Figure 6:
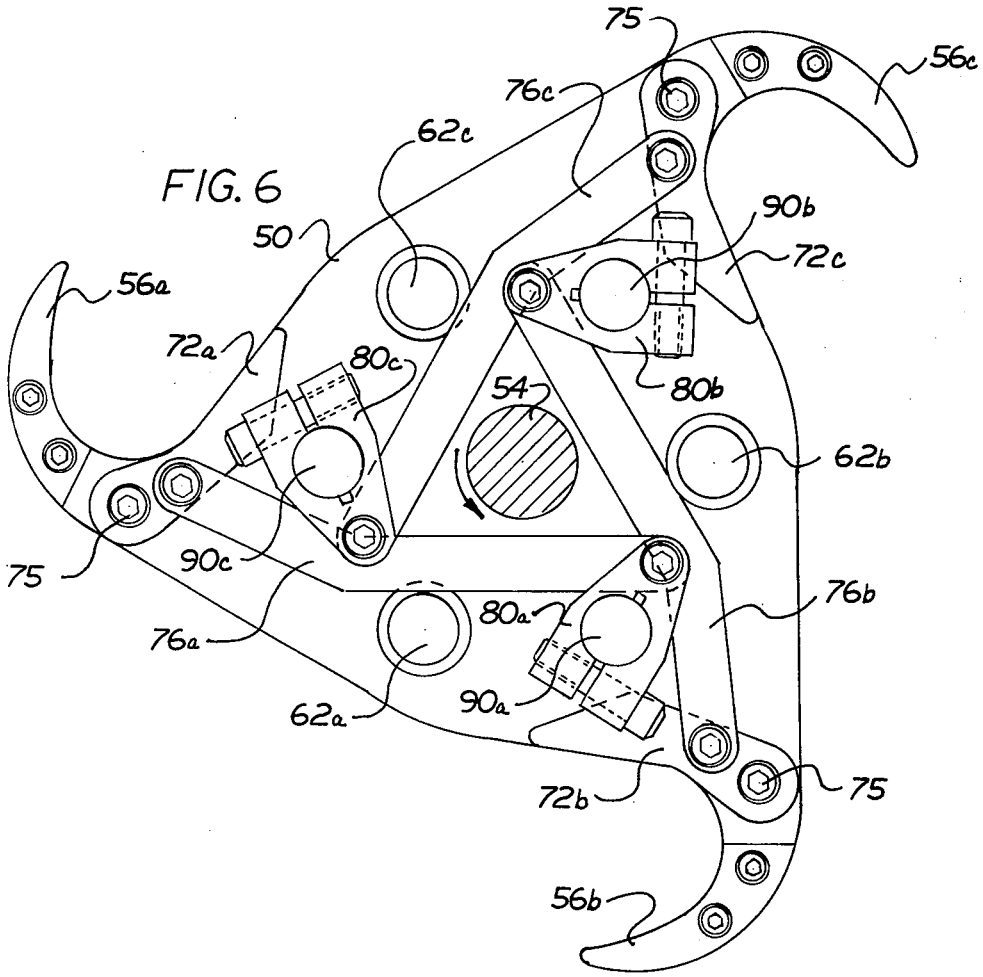
FIG. 6 is a view along the line 6—6 of FIG. 5 and to a larger scale than FIG. 5.

Each fixed tine **56*a* to 56*c* and 57*a* to 57*c* on tine plates 50 and 51 has associated therewith a gripper 72*a* to 72*c* for plate 50 and 73*a* to 73*c* for plate 51 as shown in FIGS. 3 and 6. The grippers are pivotally mounted on tine plates 50, 51 by means of pins 75. Each gripper is connected through an actuating arm 76*a* to 76*c* for tine plate 50 and 78*a* to 78*c* for tine plate 51 to a collar 80*a* to 80*c* for tine plate 50 and 82*a* to 82*c* for tine plate 51. The collars for each pair of corresponding grippers 72*a* and 73*a* to 72*c* and 73*c* are clamped onto rotatable gripper operating shafts 90*a*, 90*b* and 90*c*, respectively. The shafts 90*a* to 90*c* are supported in tine plates 50, 51** by bearings for rotation with respect to the plates.

The fixed and movable tines receive newspapers from pockets 12 and feeding apparatus 35 and combine the newspapers on delivery conveyor 28 in the following manner. As main shaft 54 is rotated clockwise as viewed in FIG. 3 both tine plates 50 and 51 are rotated in the same direction. As each pair of fixed tines **56*a* and 57*a* to 56*c* and 57*c* moves beneath pocket 12 the pair of trailing adjacent movable tines 58*a* and 59*a* to 58*c* and 59*c* is pivoted counterclockwise by rotation of its shaft 62*a* to 62*c* to a position where the movable tines are aligned with the adjacent trailing fixed tines. In FIG. 3, for example, as fixed tine 57*a* is moved into position to receive a newspaper from pocket 12 movable tine 59*c* has pivoted about shaft 62*c* to align itself with fixed tine 57*c*. This allows a clear feed path for the leading fixed tine, 57*a* in the example, to receive a complete newspaper from pocket 12. As the fixed tines receive a newspaper the associated grippers are pivoted by rotation of their common gripper shaft to close upon and grip the newspaper against the fixed tines. In the example, gripper 73*a* is pivoted by shaft 90*a* to grip the newspaper received by fixed tine 57*a*.**

As the tine plates 50, 51 continue to rotate, the movable tines which had pivoted away from the adjacent leading fixed tines are pivoted by rotation of their common shaft to their original position between two fixed tines for receiving a newspaper from feed apparatus 35. Meanwhile, the adjacent leading fixed tine has carried the newspaper from pocket 12 around and deposited it upon the delivery conveyor 28. The movable tine receives a newspaper from feed apparatus 35 in its newspaper receiving surface 68 and guides and deposits the newspaper onto delivery conveyor 28 overlapping the newspaper previously deposited by the adjacent leading fixed tine. Next, the adjacent trailing fixed tine approaches conveyor 28 and its associated grippers are retracted and the newspaper gripped thereby is deposited onto conveyor 28 overlapping the previously deposited newspaper. A stripping mechanism 98 shown schematically in FIG. 3 may be provided to strip the newspaper from each tine at the proper point to deposit the newspapers upon conveyor 28 in a lapped or shingled stream. Each succeeding set of movable and fixed tines receives newspapers and deposits them on conveyor 28 in the manner described.

Figure 5:
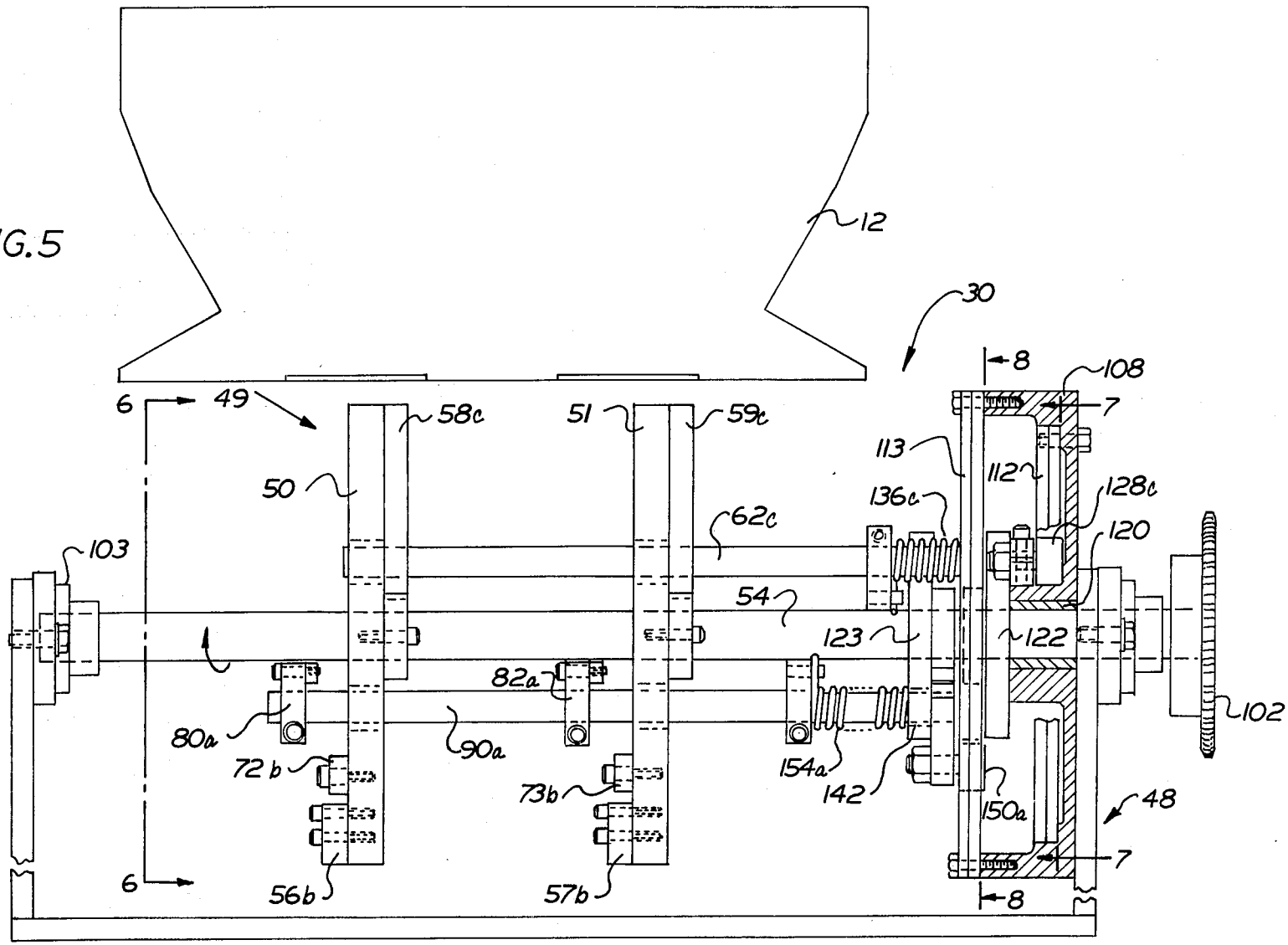
FIG. 5 is a view along the line 5—5 of FIG. 3.
Figure 7:
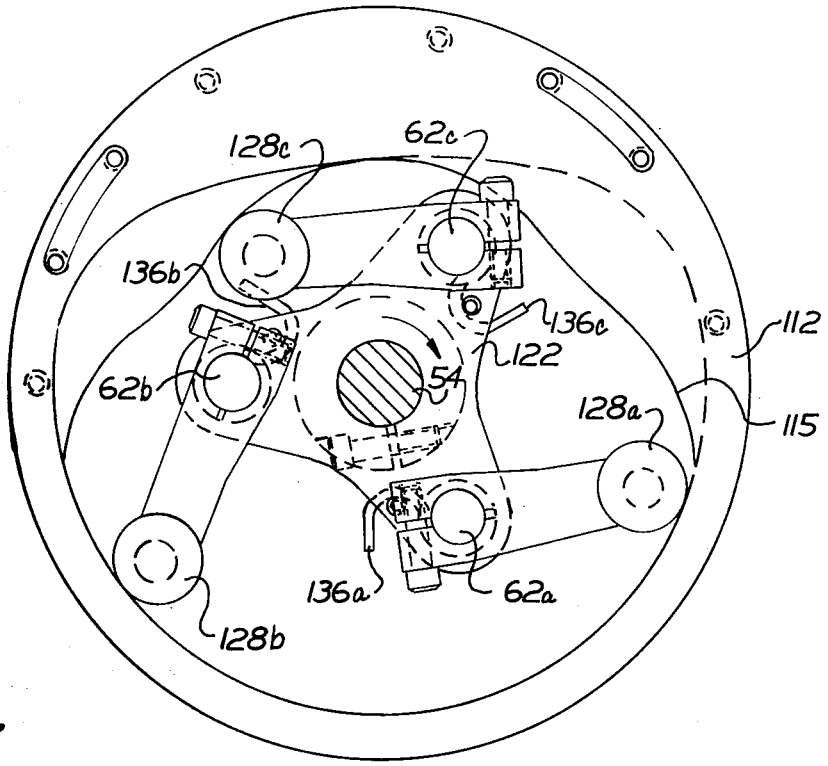
FIG. 7 is a sectional view along the line 7—7 of FIG. 5.
Figure 8:
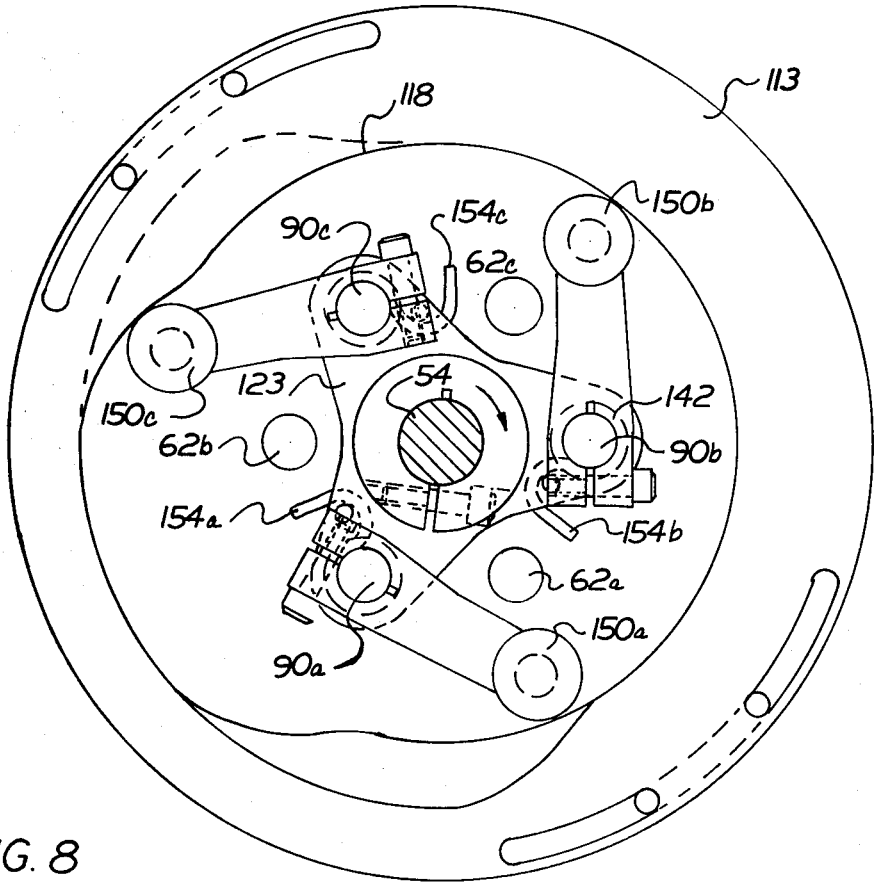
FIG. 8 is a sectional view along the line 8—8 of FIG. 5.

FIGS. 5, 7 and 8 illustrate the arrangement for rotating the tine plates and operating the grippers and the movable tines in the manner described above. As shown in FIG. 5, main shaft 54 is coupled at one end of frame 48 to a drive sprocket 102 and at the other end is mounted in bearings 103. A circular flange plate 108 is mounted at one end of frame 48 and supports a pair of cam plates 112 and 113. Cam plate 112 is provided with a radially variable cam surface 115 (FIG. 7) for controlling the operation of the movable tines and cam plate 113 has a radially variable cam surface 118 (FIG. 8) for controlling the operation of the grippers. Shaft 54 extends through bearings 120 in flange plate 108 and supports a movable tine shaft support 122 and a gripper shaft support 123. Movable tine shaft support 122 is rotated by main shaft 54 and supports movable tine shafts **62*a*, 62*b*, and 62*c* in bearings as shown in FIG. 7. A cam follower 128*a* to 128*c* is mounted on the end of each shaft 62*a* to 62*c* and adapted to follow the camming surface 115 of cam plate 112. Each movable tine shaft 62*a*, 62*b*, 62*c* is provided with a bias spring 136*a*, 136*b*, 136*c*, respectively, which is arranged to maintain the cam followers 128*a*, 128*b* and 128*c* in contact with camming surface 115**.

The gripper shaft support 123 is also rotated by main shaft 54 and supports the gripper shafts **90*a*, 90*b*, and 90*c* in respective bearings such as bearing 142 for shaft 90*a* in FIG. 5. Cam followers 150*a*, 150*b*, and 150*c* are clamped to the ends of the gripper shafts 90*a*, 90*b*, and 90*c*, respectively. Biasing springs 154*a* to 154*c* are provided to bias the respective cam followers 150*a* to 150*c* against the radially variable camming surface 118 of gripper cam 113**.

In operation, sprocket 102 in FIG. 5 is driven to rotate main shaft 54 which in turn rotates movable tine shaft support 122 and gripper shaft support 123 as well as fixed tine plates 50 and 51. The three gripper operating shafts 90*a* to 90*c* and the three movable tine shafts 62*a* to 62*c* orbit about main shaft 54. The cam followers 128*a* to 128*c* mounted on the movable tine operating shafts and the cam followers 150*a* to 150*c* mounted on the gripper operating shafts follow the contours of the respective camming surfaces 115 and 118. This causes the movable tines and gripper shafts to rotate about their own axes with respect to the fixed tine plates 50 and 51. Rotation of the gripper operating shafts 90*a* to 90*c* causes the respective grippers associated with the fixed tines to close and grip a newspaper received from pockets 12 and to open at the appropriate spot in the orbital path of the associated fixed tine for release of the newspaper onto delivery conveyor 28 as described above.

Similarly, rotation of the operating shafts 62*a* to 62*c* for the movable tines 58*a* to 59*c* causes the respective movable tines to align themselves with their adjacent trailing fixed tines to provide a path for the adjacent leading fixed tine to receive a newspaper from pocket 12 as described above. Rotation of the movable tine operating shaft in the opposite direction produced by the movable tine cam follower following the cam surface 115 causes the movable tine to then return to an extended position for receiving a newspaper from feed apparatus 35 and guiding the newspaper onto delivery conveyor 28 as described above.

While the present invention has been described above in connection with the combining of completed newspapers from a pair of stuffer assemblies, it will be appreciated that it is not restricted to such use and may be employed for combining a wide variety of sheet material assemblages and the like.

What is claimed is:

1. Apparatus for combining separate streams of sheet material assemblages into a single stream comprising a rotatable wheel, a plurality of first and second guide means spaced about the periphery of said wheel, said second guide means being movable relative to said first guide means, each of said first guide means receiving assemblages from a first stream at a first angular position in the path of said wheel and guiding said assemblages to a release station at a second angular position in the path of said wheel, each of said second guide means receiving assemblages from a second stream at a third angular position in the path of said wheel and guiding said assemblages to said release station, first means adjacent said rotatable wheel for feeding assemblages to said first guide means, second means adjacent said rotatable wheel for feeding assemblages to said second guide means, means at said release station for receiving assemblages alternately from said first and second guide means, and means for pivoting each of said second guide means between two peripherally adjacent a first position where said second guide means extends between said first guide means for receiving assemblages from said second stream and a second position where said second guide means is positioned more closely to the adjacent upstream first guide means to provide a clear path for an adjacent downstream first guide means to receive an assemblage from said first stream.

2. Apparatus as claimed in claim 1 wherein said wheel is mounted on a rotatable shaft and includes first and second plates spaced apart on said shaft, said plates having said alternately spaced first and second guide means at corresponding positions about their peripheries.

3. Apparatus as claimed in claim 1 wherein said pivot means includes an operating shaft supporting said second guide means and rotatable with said wheel, and camming means for causing said operating shaft to rotate with respect to said wheel while said wheel and shaft are rotating together, whereby said second guide means is moved between said first and second positions.

4. Apparatus as claimed in claim 1 wherein each of said first and second guide means comprises tines adapted to receive said assemblages.

5. Apparatus as claimed in claim 1 further comprising gripping means associated with each of said first guide means for gripping assemblages received from said first stream and carrying said assemblages to said release station, said gripping means includes a gripper, a gripper operating shaft rotatable with said wheel, and camming means for causing said operating shaft to rotate with respect to said wheel while said wheel and shaft are rotating together, whereby said grippers are operated to grip and relese assemblages.

6. Apparatus as claimed in claim 1 wherein said second feeding means includes means for curving each assemblage to stabilize it in its path to said second guide means, said means for curving each assemblage including a rotatable disc, beneath which each assemblage is passed in a flat condition, for establishing a center line of curvature substantially midway between the ends of each assemblage between a set of inclined rollers for inclining the ends of each assemblage.

7. Apparatus for combining separate streams of sheet material assemblages into a single stream comprising a rotatable shaft, a pair of tine plates spaced apart on said shaft and defining a tine wheel, each plate having a plurality of tines on its periphery at corresponding angular positions, said tines including first tines for receiving assemblages from a first stream at a first angular position of said wheel and second tines movable relative to said first tines for receiving assemblages from a second stream at a second angular position of said wheel, each of said tines guiding said assemblages to a release station at a third angular position of said wheel, and means for moving said second tines with respect to said first tines between an assemblage receiving position at said second angular position of said wheel where said second tines extend out from the axis of rotation of said wheel between two peripherally adjacent said first tines and a position where said second tines are positioned more closely to the adjacent upstream first tine to provide a clear assemblage receiving path for said adjacent downstream first tine when said adjacent downstream first tine is at said first angular position of said tine wheel.

* * * * *

UNITED STATES PATENT AND TRADEMARK OFFICE

CERTIFICATE OF CORRECTION

PATENT NO. : 4,211,320

DATED : July 8, 1980

INVENTOR(S) : Michael S. Yautz, Jr. and Richard N. Winslow

It is certified that error appears in the above–identified patent and that said Letters Patent are hereby corrected as shown below:

Column 5, line 56, delete after the word between, "two peripherally adjacent"

Column 5, line 58, insert after the word between, --two peripherally adjacent--

Signed and Sealed this

*Fourth* Day of *November 1980*

[SEAL]

*Attest:*

SIDNEY A. DIAMOND

*Attesting Officer*

*Commissioner of Patents and Trademark*